US006094747A

United States Patent [19]

Malick

[11] Patent Number: 6,094,747

[45] Date of Patent: Aug. 1, 2000

[54] RING PROTECTOR

[76] Inventor: Jay Malick, Apt. O, 0315 Sterling Bay La. West, Cornelius, N.C. 28031

[21] Appl. No.: 08/969,508

[22] Filed: Nov. 13, 1997

Related U.S. Application Data

[60] Provisional application No. 60/042,526, Apr. 1, 1997.

[51] Int. Cl.[7] ..... A41D 19/00; A44C 9/00; A44C 19/00

[52] U.S. Cl. ..... 2/159; 2/170; 2/21; 63/1.18; 63/3.1; 63/15.8

[58] Field of Search ..... 2/16, 21, 159, 2/162, 163, 170; 63/1.18, 3.1, 15, 15.8

[56] References Cited

U.S. PATENT DOCUMENTS

| | | | |
|---|---|---|---|
| D. 67,090 | 7/1925 | Staub | 63/1.18 |
| D. 257,408 | 10/1980 | Talty | D2/361 |
| D. 271,227 | 11/1983 | Francisco | D21/238 |
| D. 334,085 | 3/1993 | Niemann | D29/20 |
| D. 351,930 | 10/1994 | Snider et al. | D29/113 |
| D. 358,687 | 5/1995 | Kim | D29/113 |
| D. 364,007 | 11/1995 | McLaren et al. | D29/113 |
| D. 373,225 | 8/1996 | Theroux et al. | D29/114 |
| D. 373,656 | 9/1996 | Sorrels | D29/114 |
| 417,569 | 12/1889 | Margileth | 63/1.18 |
| 732,532 | 6/1903 | Fallek | 63/15 |
| 1,628,278 | 5/1927 | Scheuer | 63/3.1 |
| 1,691,445 | 11/1928 | Meliodon | 63/1.18 |
| 3,880,426 | 4/1975 | Morse | 2/170 |
| 3,994,025 | 11/1976 | Petroski | 2/20 |
| 4,121,360 | 10/1978 | Vlerebome | 63/1.18 |
| 4,689,828 | 9/1987 | Brewer | 2/21 |
| 4,733,410 | 3/1988 | Glotkin | 2/21 |
| 4,809,366 | 3/1989 | Pratt | 2/170 |
| 4,831,997 | 5/1989 | Greene | 124/35 |
| 4,881,275 | 11/1989 | Cazares et al. | 2/21 |
| 4,899,916 | 2/1990 | Townsend | 223/101 |
| 4,908,881 | 3/1990 | Field | 2/21 |
| 5,492,984 | 2/1996 | Loch | 63/2 |

*Primary Examiner*—Michael A. Neas
*Attorney, Agent, or Firm*—Jeffrey C. Lew

[57] ABSTRACT

A device for protecting a decorative ring or band worn on the finger includes a wristband, a retaining member worn on a finger beyond the ring or band, and means for connecting the retaining member to the wristband.

20 Claims, 3 Drawing Sheets

Fig. 1
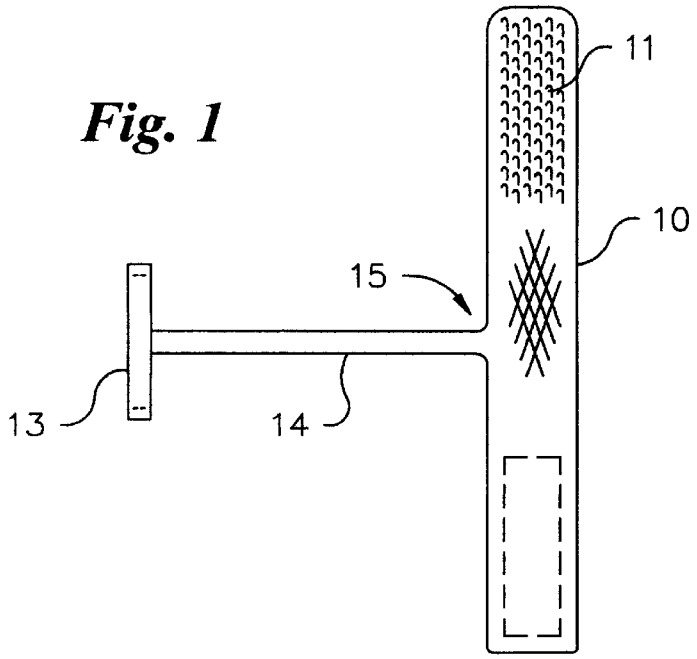
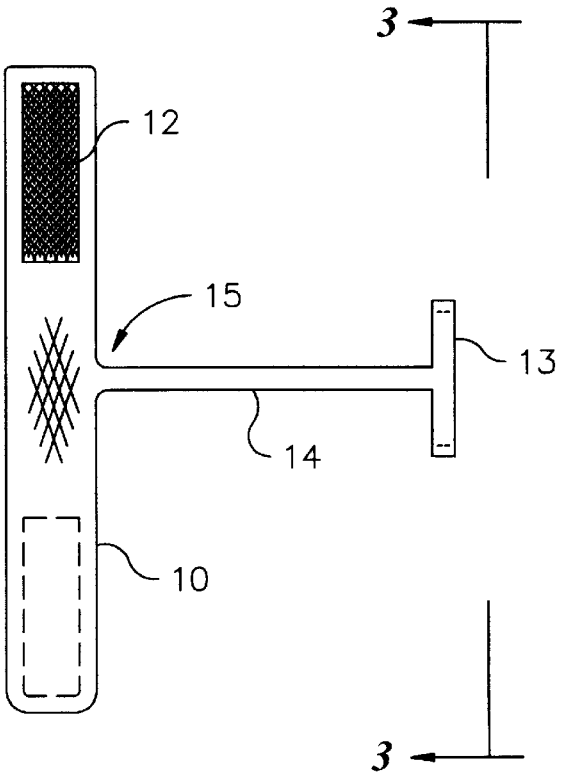
Fig. 2
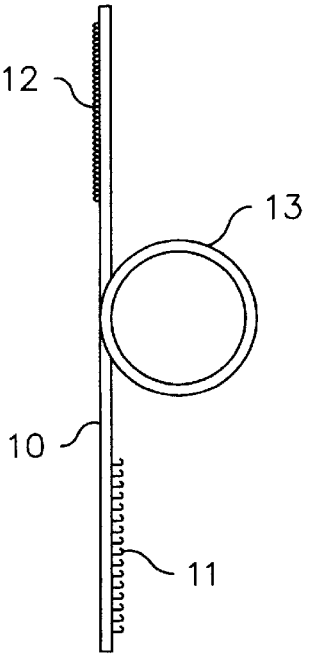
Fig. 3

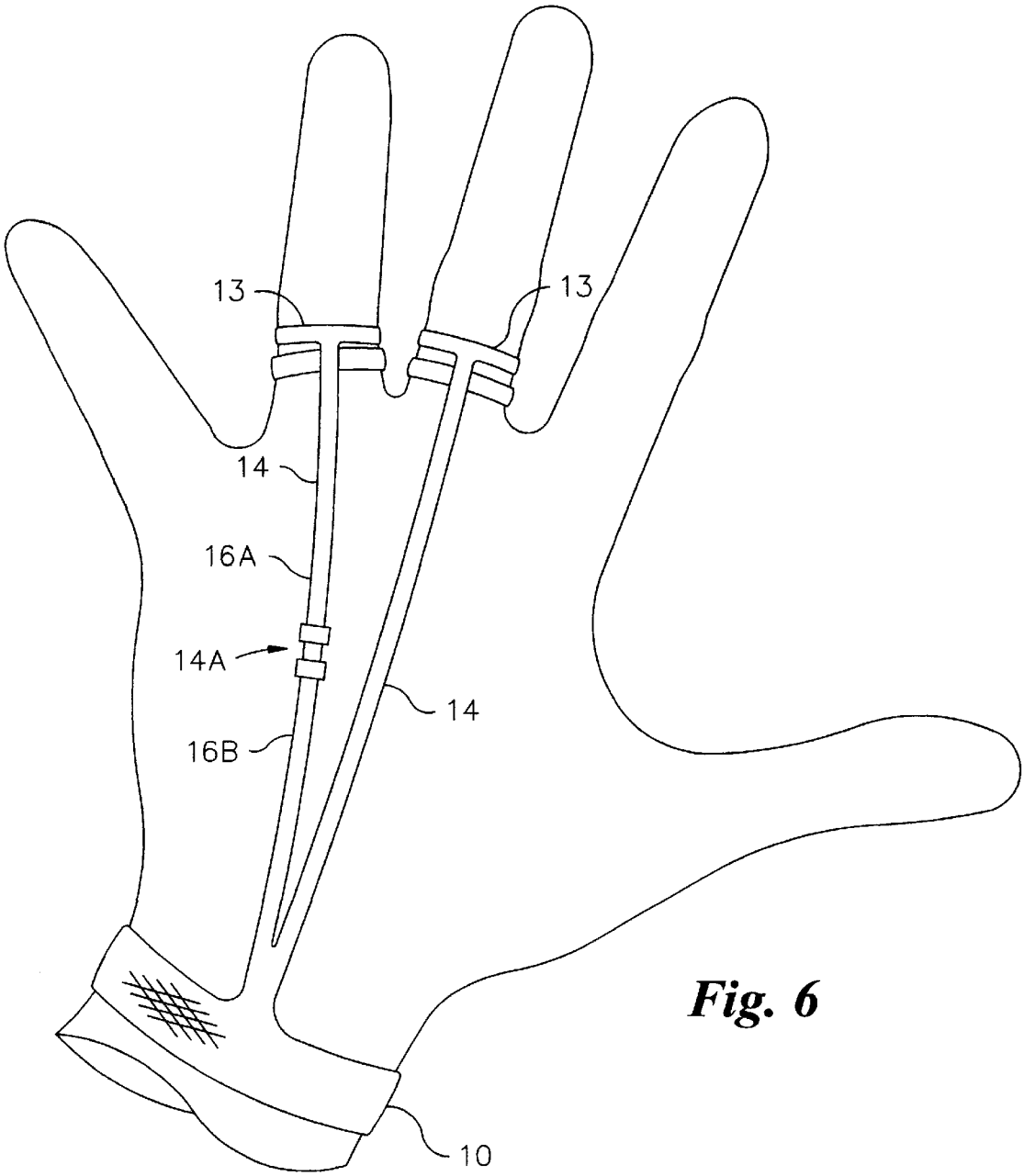
Fig. 6
Fig. 7
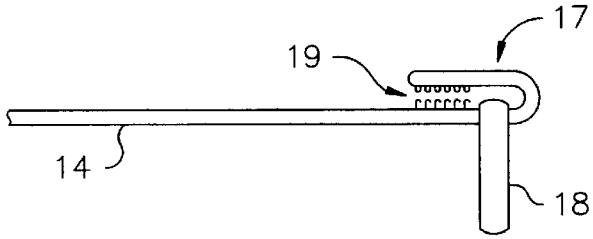

RING PROTECTOR

This application claims benefit of provisional application Ser. No. 60/042,526, filed Apr. 1, 1997.

BACKGROUND AND SUMMARY OF THE INVENTION

The present invention is a device for protecting rings and other types of decorative bands worn on the fingers of one's hand from becoming lost while the bands are being worn, especially during periods of physical exercise by the wearer. The protection device comprises a wristband, a retaining member, and a resilient connecting strip for connecting the wristband to the retaining member. The wristband can be any band, bracelet or strap suitable for being worn comfortably but securely on the wrist.

The retaining member can be a ring or circular band of resilient material suitable for being worn on the finger adjacent to, but outward from, the ring or band to be protected. Alternatively, the retaining member can be a resilient C-shaped retainer for engaging the finger adjacent to, but outward from, any ring being worn. In either instance, the retaining member prevents sliding and oftentimes sudden movement of a ring or decorative band being worn away from its normal position near the base of the finger toward the fingertip.

A resilient connecting strip connects the wristband and the retaining member and thereby restrains the retaining member comfortably on the finger to prevent loss of a ring or decorative band inadvertently by the wearer during any period, as when ambient temperatures are extreme (e.g., cold), when the wearer's attention may be distracted, such as during physical exercise. Contemplated physical exercise includes, but is not limited to, swimming, running, water skiing, for example, or the type of exercise engaged in around the home and garden.

BRIEF DESCRIPTION OF THE DRAWINGS

FIG. 1 is a front elevational view of one embodiment of the invention.

FIG. 2 is a rear elevational view of the embodiment shown in FIG. 1.

FIG. 3 is a sectional view taken along line 3—3 of FIG. 2.

FIG. 6 is a plan view of an alternate embodiment of the invention in relation to an outline of a hand.

FIG. 7 is a partial elevational view of an alternate retaining means according to the invention.

DETAILED DESCRIPTION OF THE INVENTION

The present invention is a device for preventing the accidental loss of decorative bands and rings while they are being worn during periods of intense physical exercise or as a result of sudden involuntary movement, e.g., jerk, lunge, etc., by the wearer. As used herein the term "band", as in "decorative band", is intended to include any form of ring of the type typically worn on a wearer's finger. Referring to FIG. 1, the protection device comprises a wristband 10, which, in the embodiment shown, is an elongated strip of material of suitable length to be wrapable around the wrist of a wearer so as to overlap at the end portions. A contact-fastenable fastener system is provided in the embodiment shown where the end portions of the strip overlap for removably securing the wristband on a wrist. In a preferred embodiment, the fastener system comprises hook and loop fasteners 11, 12 formed from Velcro® fastener strips or other contact-fastenable surfaces sewn on opposite mating surfaces near the end portions of the elongated strip as shown in FIGS. 1 and 2. However, the Velcro® strips can be located in opposing relationship at any convenient position along the elongated strip which allows a wearer to conveniently and easily fasten the wristband about the wrist. Alternatively, mechanical fastening means, such as snaps, buttons, buckles or interlocking rings can be substituted for fasteners 11, 12.

Figure 5:
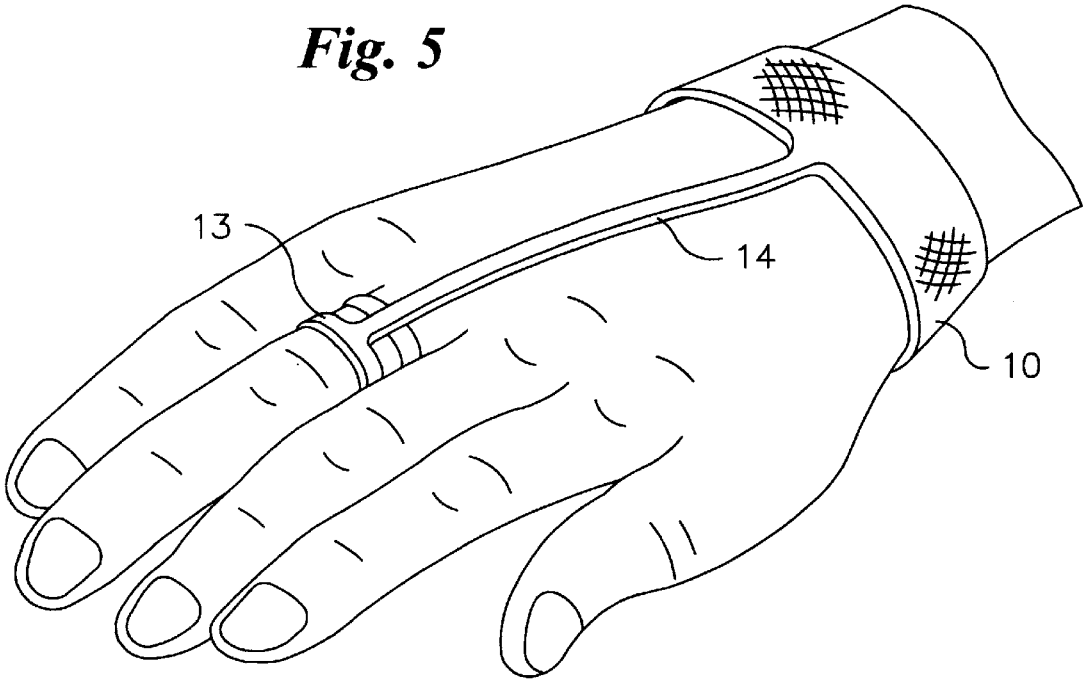
FIG. 5 is a front perspective view of an alternate embodiment of the invention shown in relation to a wrist and hand.

The elongated strip comprising wristband 10 can be of any suitable solid or woven material, such as, for example, plastic, rubber, leather, or fabric. Preferably, the strip is a woven elastic fabric of cotton and rubber. Alternatively, the wristband can be a continuous woven elastic fabric band of a size which can be stretched to pass over a hand, but which will recover its size and shape to be worn comfortably and securely on the wrist of a wearer as shown in FIGS. 5 and 6.

Figure 4:
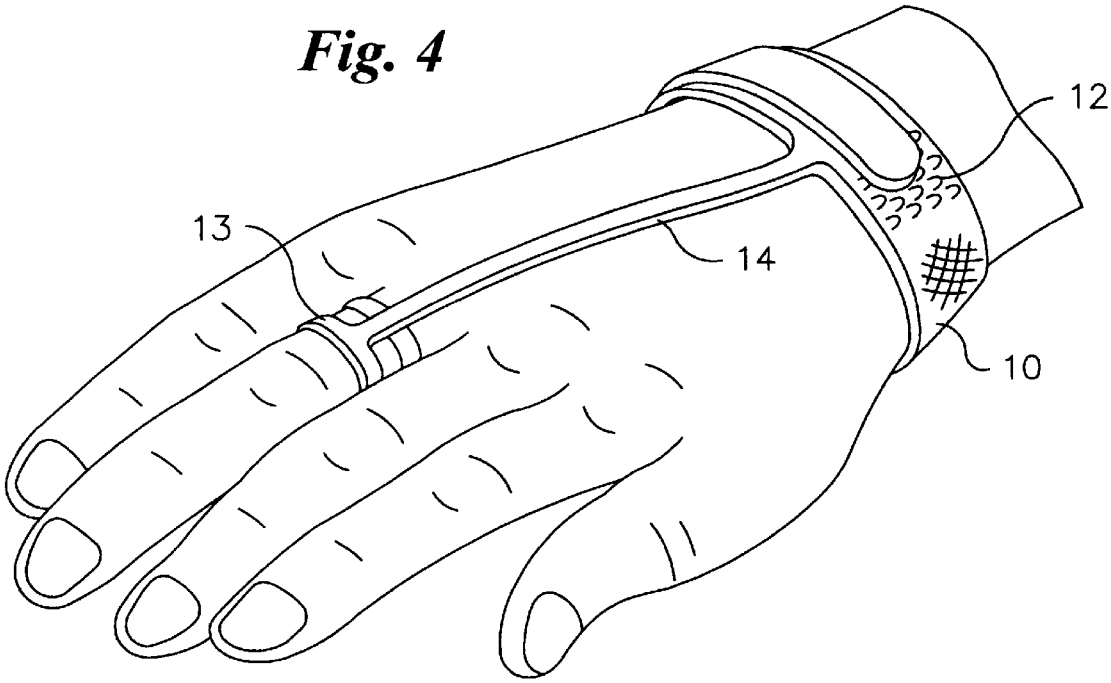
FIG. 4 is a front perspective view of one embodiment of the invention shown in relation to a wrist and hand.

Retaining member 13 is a ring or band of metal, rubber or other resilient, i.e., elastomeric, material of a size and thickness to be worn comfortably on a finger. As shown in FIGS. 4 and 5, the retaining member 13 is worn adjacent to and outward from the ring or band to be protected. Alternatively, although not shown in the figures, retaining member 13 can be C-shaped and made of metal or plastic having a size and thickness for being worn on a finger. When retaining member 13 is metal, it can be overwrapped with woven elastic material. Retaining member 13 can also be formed from the same woven elastic fabric used for the wristband 10. The retaining member is positioned to prevent unexpected sliding movement of a ring or decorative band away from its normal position near the base of the finger toward the fingertip.

A generally resilient connecting strip 14 connects the wristband 10 with the retaining member 13. As shown in FIGS. 4, 5 and 6, connecting strip 14 operates to maintain the position of retaining member 13 on the finger of a wearer relative to wristband 10 such that a ring being worn on the finger inwardly from the retaining member 13 will be prevented from sliding off the finger. According to one embodiment, retaining member 13 and connecting strip 14 are molded as a single, i.e., unitary, piece using any injection moldable elastomeric material which is generally soft yet resilient, i.e., moderately stretchable. Connecting strip 14 can be attached to wristband 10 as shown in FIG. 1 at 15 by any convenient means. Where wristband 10 is a woven elastic fabric, connecting strip can be fastened by sewing the strip into the elastic fabric material.

In use, retaining member 13 is normally first placed over the finger adjacent the ring to be protected with connecting strip 14 positioned to lay flatly along the top portion of the hand. Alternatively, the retaining device can be worn so that connecting strip 14 is positioned to lay flatly along the palm of the hand. Wristband 10 can then be positioned on the wrist by wrapping the elongated strip about the wrist and securing it by means of the fastener system as shown in FIG. 5. When wristband 10 is a continuous woven elastic band, it will still be most convenient for a wearer to position retaining member 13 on the finger on which it is to be worn first, and then slide the elastic wristband 10 over the hand and onto the wrist whereby connecting strip 14 lays flatly along the top or palm of the hand. The device can be worn for any type of activity and will not restrict full motion of the hand.

Referring now to FIG. 6, there is shown an alternate embodiment of the invention in relation to the outline of a hand. A wristband 10 as described above includes two resilient connecting strips 14 and two retaining members 13. One of the resilient connecting strips 14A includes two members 16A and 16B arranged for sliding engagement with each other whereby the overall length of the connecting strip can be adjusted at the convenience of the wearer.

Referring now to FIG. 7 there is shown a partial elevational view of an alternate means for adapting resilient connecting strip 14 for retaining a ring on a finger. Resilient connecting strip 14 can be fabricated to eliminate a discreet retaining member 13 by elongating the strip and allowing it to pass beneath the ring of a wearer, shown as 18, and be folded back upon itself as shown in somewhat exaggerated view at 17. A Velcro contact fastenable system or a snap can be employed at the region of overlap for securing the end of the connecting strip to itself.

Although the present invention has been described with reference to the embodiments shown in the figures, persons skilled in the art will recognize that changes may be made in form and detail without departing from the spirit and scope of the invention.

What is claimed is:

1. A device for protecting decorative bands worn on the fingers of a wearer's hand which comprises a wristband, at least one retaining member adapted to be worn on the wearer's finger at a position outward of the decorative band and adapted to expose the fingers outward or the distal interphalangeal joints, and a resilient connecting strip for connecting the wristband to said at least one retaining member, the strip being operative to maintain the position of the retaining member relative to the wristband without restricting motion of the hand.

2. The device of claim 1 wherein said wristband comprises an elongated strip of woven elastic fabric having means for removably attaching said strip to a wrist.

3. The device of claim 2 wherein the means for removably attaching said strip to a wrist comprises contact fastenable fastening surfaces on opposite mating surfaces of the strip.

4. The device of claim 1 comprising a plurality of retaining members and a plurality of resilient connecting strips wherein each connecting strip connects a separate retaining member to the wristband.

5. The device of claim 4, comprising two retaining members and two connecting strips.

6. The device of claim 1 further comprising means for adjusting the length of the connecting strip.

7. The device of claim 1 in which the retaining member and connecting strip are a unitary piece of an elastomeric material.

8. A device for protecting decorative bands worn on the fingers of a wearer's hand which comprises a wristband arranged to be worn on the wrist, a resilient connecting strip integral with said wristband and of sufficient length to extend from said wristband along the hand and under said decorative band, said resilient connecting strip adapted to be folded over said band and back upon itself, and means for securing the resilient connecting strip to itself at the point of overlap.

9. A device for protecting decorative bands worn on the fingers of a wearer's hand which comprises a wristband comprising an elongated strip of woven elastic fabric having means for removably attaching said elongated strip to a wrist, at least one retaining member adapted to be worn on the wearer's finger at a position outward of the decorative band, and a resilient connecting strip for connecting the wristband to said at least one retaining member, the connecting strip being operative to maintain the position of the retaining member relative to the wristband without restricting motion of the hand.

10. The device of claim 9 wherein the means for removably attaching said elongated strip to a wrist comprises contact fastenable fastening surfaces on opposite mating surfaces of the strip.

11. The device of claim 9 comprising a plurality of retaining members and a plurality of resilient connecting strips wherein each connecting strip connects a separate retaining member to the wristband.

12. The device of claim 11 comprising two retaining members and two connecting strips.

13. The device of claim 9, further comprising means for adjusting the length of the connecting strip.

14. A device protecting decorative bands worn on the fingers of a wearer's hand which comprises a wristband, at least one retaining member adapted to be worn on the wearer's finger at a position outward of the decorative band and a resilient connecting strip for connecting the wristband to said at least one retaining member, the strip being operative to maintain the position of the retaining member relative the the wristband without restricting motion of the hand and in which the retaining member and connecting strip are a unitary piece of an elastomeric material.

15. A device for protecting decorative bands worn on the fingers of a wearer's hand which comprises a wristband, at most two retaining members adapted to be worn on the wearer's finger at a position outward of the decorative band and a resilient connecting strip for connecting the wristband to said retaining members, the strip being operative to maintain the position of the retaining members relative to the wristband without restricting motion of the hand.

16. The device of claim 15 which has one retaining member.

17. The device of claim 15 which has two retaining members.

18. The device of claim 15 further comprising means for adjusting the length of each connecting strip.

19. A device for protecting decorative bands worn on the fingers of a wearer's hand which comprises a wristband, at least one retaining member adapted to be worn on the wearer's finger at a position outward of the decorative band and inward of the distal interphalangeal joint, and a resilient connecting strip for connecting the wristband to said at least one retaining member, the strip being operative to maintain the position of the retaining member relative to the wristband without restricting motion of the hand.

20. The device of claim 19 in which the at least one retaining member is adapted to be worn at a position on the finger inward of the proximal interphalangeal joint.

* * * * *